United States Patent [19]

Sepmeyer et al.

[11] 3,980,827

[45] Sept. 14, 1976

[54] DIVERSITY SYSTEM FOR NOISE-MASKING

[76] Inventors: Ludwig W. Sepmeyer, 1862 Comstock Ave., Los Angeles, Calif. 90025; John P. Jarvis, 19120 Nordhoff St., Northridge, Calif. 91324

[22] Filed: Dec. 19, 1974

[21] Appl. No.: 534,214

[52] U.S. Cl. ..... 179/1 P

[51] Int. Cl.[2] ..... H04R 3/00

[58] Field of Search ..... 179/1 P, 1.5 M, 1.5 R, 179/100.2 K, 1 G, 1 AA, 1 AT, 1 F, 1 E; 181/.5 AP, 33 C, 33 L, 33 P, 198, 199; 253/39 N; 325/406

[56] References Cited

UNITED STATES PATENTS

| | | | |
|---|---|---|---|
| 3,138,667 | 6/1964 | Avedon | 179/1 E |
| 3,280,258 | 10/1966 | Curtis | 179/1 G |
| 3,308,237 | 3/1967 | Novak | 179/1 E |
| 3,478,167 | 10/1969 | Sorkin | 179/1 G |
| 3,567,863 | 3/1971 | Morrissey | 179/1 AA |

FOREIGN PATENTS OR APPLICATIONS

| | | | |
|---|---|---|---|
| 655,508 | 1/1938 | Germany | 181/33 L |
| 988,444 | 4/1965 | United Kingdom | 181/33 L |

OTHER PUBLICATIONS

The Journal of the Acoustical Society of America, vol. 34, No. 8, Aug. 1962, by Wallace Dean, III, pp. 1039–1044.

*Primary Examiner*—Kathleen H. Claffy
*Assistant Examiner*—Joseph A. Popek
*Attorney, Agent, or Firm*—Allan M. Shapiro

[57] ABSTRACT

Masking-noise speakers are positioned in an array of lines and rows to direct masking noise into a space. Two separate noise generators provide noise signals respectively to two equalizer-amplifiers which provide their signals respectively to first and second narrow band equalizers. These channel signals are respectively delivered through power amplifiers to first and second sets of speakers in the speaker array. The first and second channel signals are combined to produce a third channel signal, are power amplified, and delivered to a third set of speakers in the array so that no two adjacent speakers on any line or row are powered by the same noise signal. In a modified arrangement, the combination of the first and second channel signals is made after power amplification.

11 Claims, 5 Drawing Figures

Fig. 1
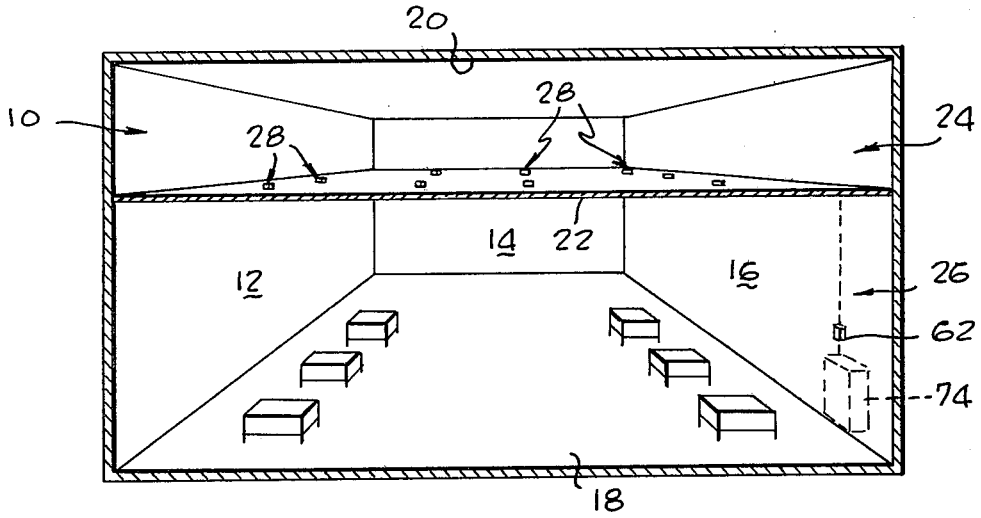
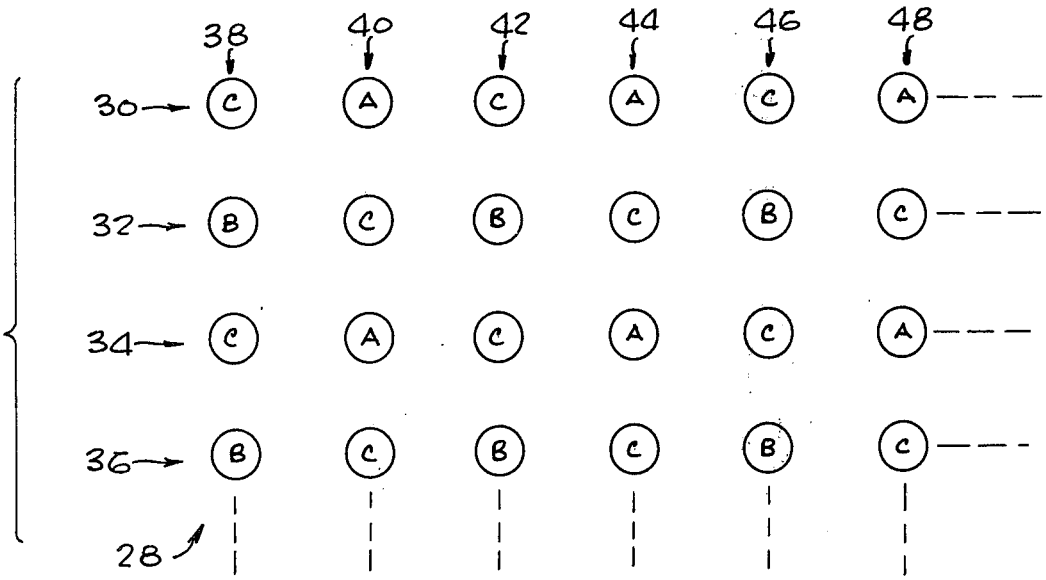
Fig. 2

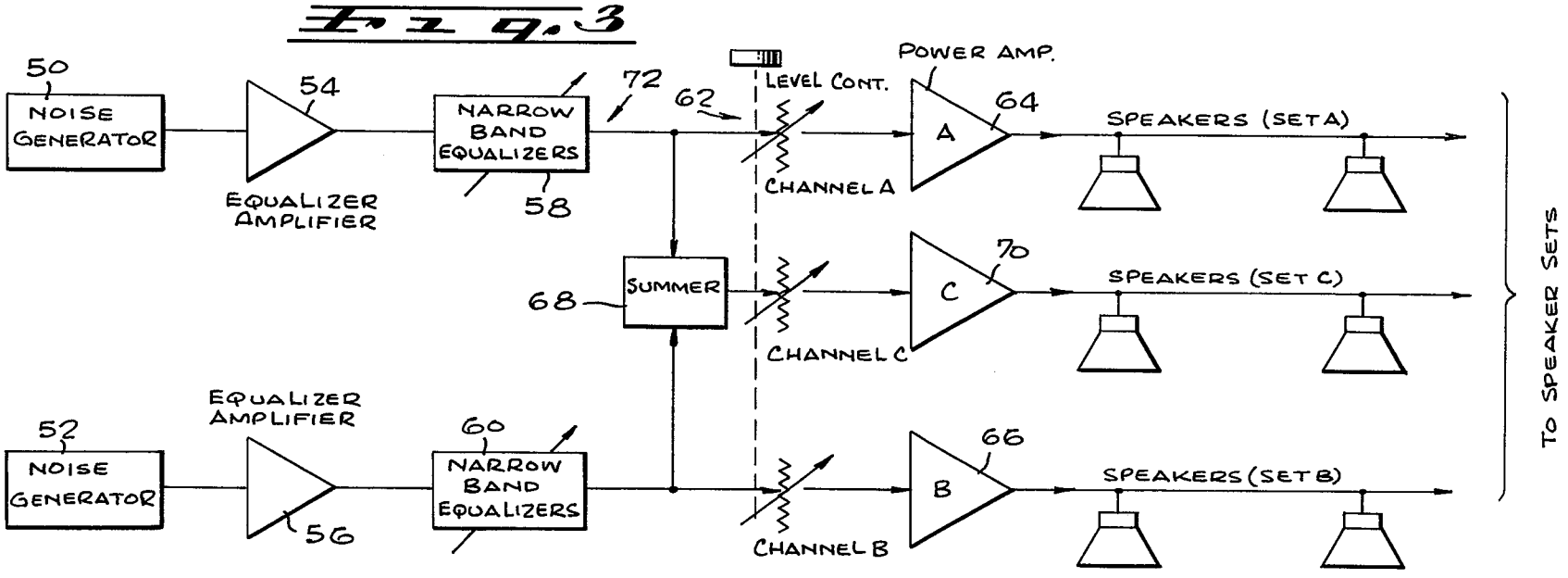
Fig. 3
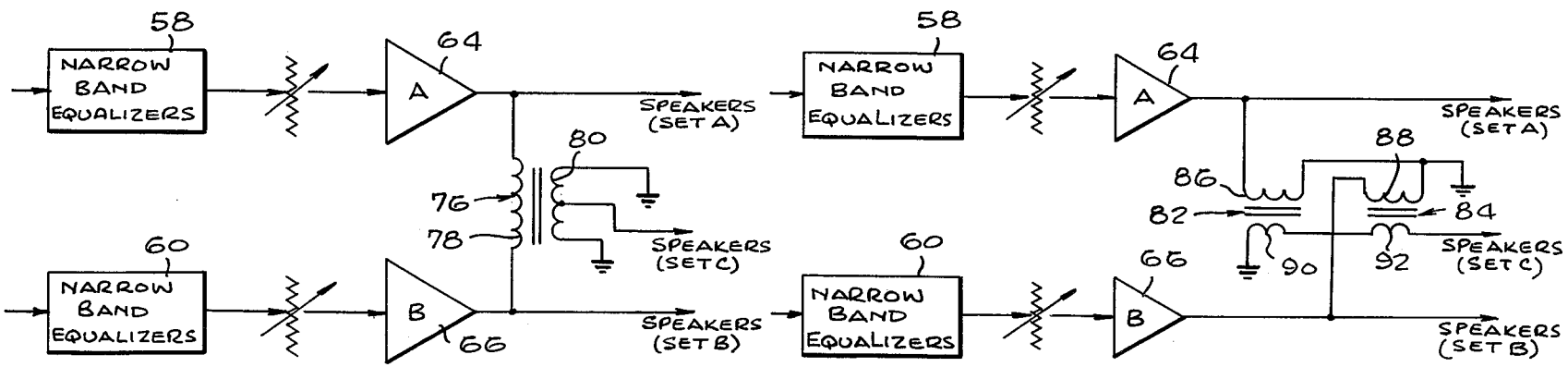
Fig. 5
Fig. 4

DIVERSITY SYSTEM FOR NOISE-MAKING

BACKGROUND OF INVENTION

1. Field of the Invention

This invention is directed to a diversity system for noise-masking which includes a particular noise supply system to power three sets of speakers and the arrangement of the three sets of speakers to provide desirable noise-masking conditions.

2. Description of the Prior Art

Designers of large office operations have abandoned the practice of placing each desk in its own small room. Instead, today's office arrangement concept is to provide spacious open floors which are shared by many desks. The new concept, when employed to its greatest advantage, affords better efficiency and an informal atmosphere; however, it is desirable to retain one property which is automatically provided by small or individual offices. This property is the privacy of conversation. The conversation may be with another worker or on the telephone. The protection of each worker from the distracting intrusion of noises from adjacent sources, such as conversations, business machines, and telephone ringing, is a critical factor detrimental to this design. The open plan concept has gone beyond the office and is finding acceptance in classrooms and in hospital patient rooms. The specific details of the problem differ from the office requirements, but the basic goal is the same. In the hospital ward, each patient should be isolated from the sounds of the other patients, their conversations, and TV sets. In schools, the problem is more difficult because one large room may be shared by several classes of students. Each class must be acoustically coupled within itself, but each class must be acoustically separated from the adjacent one.

The use of sound-absorbing acoustical material is a basic element in the design of such spaces. Use of carpeting and wall and ceiling acoustical surfaces is common. In addition, panels and sound barriers are individually arranged to aid in the separation of spaces; however these measures cannot provide an adequate solution.

Most of the open-spaced offices are defined above by a ceiling, and above the ceiling is a plenum in which the office services are channeled. Sprinkler piping, water piping, air-conducting duct work, electrical conduits, and the like are routed through the plenum space.

The prior art provides background masking noise, but the noise must be uniformly distributed through the space in order to achieve the satisfactory end results. If the noise is not uniform, masking is ineffective in one area, and a person walking through the room would be subject to different intensities of background noise and thus would become conscious of it. The prior art systems mostly utilize commercial sound system components and then use sound contractors to install the loudspeakers in the plenum space above the open plan office ceilings. The plenum space above the ceilings is usually cluttered with air-conditioning ducts and electrical conduits. The speakers are positioned so that the plenum space is utilized as a mixing chamber for the background noise and, in theory, this mixing chamber distributes the sound over the entire ceiling area. With the utilization of the plenum space as a mixing chamber, in theory, the noise filters down uniformly through the ceiling and into the office space; however, this is only potentially true when the plenum is unobstructed and acoustically hard. The insulated air-conditioning ducts and the other equipment in the plenum interfere with this distribution and thus the plenum does not act as the theoretically uniform mixing chamber. Now, individualized positioning of the speakers by field acoustic technicians is required, in order that the masking sound be uniform in the office space below.

SUMMARY OF THE INVENTION

In order to aid in the understanding of this invention, it can be stated in essentially summary form that it is directed to a diversity system for noise-masking wherein three separate equalized noise channels are produced by two noise generators respectively supplying two narrow band equalizers to produce two channel signals which are combined to produce the third channel signal and the three channels are connected into a speaker array arranged in rows and lines so that along the rows and lines no two adjacent speakers are powered by the same noise channel.

Accordingly, it is an object of this invention to provide a diversity system for noise-masking where an economic noise-generating system which includes only two narrow band equalizers provides equalized noise output in three channels. It is an another object to provide a structure where first and second noise channels each comprise a random or white noise generator, an equalizer-amplifier, a narrow bandwidth equalizer, and a power amplifier to supply equalized noise signal power in the audio-frequency respectively to first and second speaker sets in the speaker array and to combine the outputs of the narrow band equalizers and amplify the combined output to provide a third noise channel to supply a third set of speakers in the speaker array. It is a further object to provide an economic system which provides sufficient diversity to prevent noise interference and yet employ only two narrow band equalizers. It is a further object of this invention to provide a system of loudspeakers arranged in lines and rows and directed into work space with the speakers arranged in three sets with the speakers of the first and third sets alternating on one row and with speakers of the second and third sets alternating on the adjacent row so that, in the lines and rows, speakers of the same set do not lie adjacent each other.

The features of the present invention which are believed to be novel are set forth with particularity in the appended claims. The present invention, both as to its organization and manner of operation, together with further objects and advantages thereof, may be understood best by reference to the following description taken in connection with the accompanying drawings.

BRIEF DESCRIPTION OF THE DRAWINGS

FIG. 1 is a perspective view of a space, and particularly an office space with the near wall broken away so that the interior arrangement of the space, including the positioning of speakers directed into the work space thereof, is illustrated.

FIG. 2 is a diagrammatic illustration of the arrangement of the three sets of speakers into the speaker array which directs diverse masking noise into the work space.

FIG. 3 is a block diagram of the system which provides diverse noise signals to the three speaker sets.

FIG. 4 is a block and schematic diagram of a modified system with power summation.

FIG. 5 is another block and schematic diagram of a further modified system with power summation.

DESCRIPTION OF THE PREFERRED EMBODIMENT

FIG. 1 illustrates a room or other work space 10 which is defined by four walls, three of which are shown at 12, 14, and 16, floor 18 and roof 20. Suspended ceiling 22 divides the room 10 into plenum 24 and office space 26. As is seen in FIG. 1, the office space is of the open-plan arrangement.

In order to achieve speech privacy in open-plan offices, such as office space 26, several acoustical requirements must be met. The ceiling 22 should be as high as possible and be very highly absorptive, in order to minimize the sound energy reaching the unintended listener by way of the ceiling-reflected path. Furthermore, absorptive surfaces should also be employed on the walls and the floors. Background masking noise is employed to mask the speech sounds which do reach the unintended listeners. In order to be as unobjectionable as possible and to maximize the masking, the background noise must have a smooth frequency characteristic and be completely random. For maximum masking efficiency, the spectrum shape of the background noise should conform to the spectrum shape of speech. Additionally, the background masking sound system should provide a substantially uniform amplitude characteristic throughout the entire office space 26 so that, as a person walks through the office space, he is not made conscious of the background masking sounds, as he would be if the perceived amplitude of the sounds were substantially different, as a function of frequency, in different locations.

Speaker array 28 is shown as installed on the top of the suspending ceiling in FIG. 1, with the speakers projected downward, and is shown in projected arrangement in FIG. 2. Speaker array 28 is arranged in a plurality of rows such as, for example, rows 30, 32, 34 and 36 and in a plurality of lines such as, for example, lines 38, 40, 42, 44, 46 and 48. The lines and rows are preferably rectangularly arranged, and it has been found that, with a normal 8 to 10 foot center-to-center arrangement of rows and lines is practical.

In the prior art, it has been found that, with a single electrical noise source supplying loudspeakers in a regularly spaced loudspeaker array, rather severe and unpleasant peaks and dips of sound intensity occur. This is due to the interference effect of adjacent speakers in which path length differences from the several loudspeakers algebraically add and subtract. As a result, when one moves his head just a few inches, the character of the masking noise noticeably changes and makes the masking noise psychologically unacceptable. By placing three speaker sets powered with different noises in the speaker array, this objectionable result can be overcome.

As seen in FIG. 2, the three different speaker sets in the arrays are identified by the letters A, B, and C. In row 30, speakers of sets A and C alternate; in row 32, speakers of sets B and C alternate with the set C speakers being in different lines. Thus, line 38 has speakers from sets B and C alternating therein, while line 40 has speakers from sets A and C alternating therein. Lines 38, 42 and 46 are the same, while lines 40, 44 and 48 are the same. Similarly, rows 30 and 34 are the same, while rows 32 and 36 are the same. The array 28 can be arranged on the suspended ceiling with the lines and rows going either way in the room, that is, the rows can be either on the longer or shorter dimension of the room. Furthermore, the lines and rows can be arranged diagonally in the room, if desired. The distance between the lines and rows is preferably equal so as to place the speakers at the corners of squares. There is a sufficient number of rows and lines as required by the dimensions of the room. Thus, the speaker array extends over the entire room to distribute masking noise over the entire room. The individual speakers are preferably mounted directly on the suspended ceiling and are directed downward to project the sound into the work space 26 portion of the room.

As discussed above, to avoid interference between speakers, each of the speaker sets A, B and C must be powered with a different noise. While it is possible to power each speaker with its own individual noise source, such requires an excessively large number of noise sources and amplifiers. Furthermore, equalization of the sound is desirable, as discussed below. The acoustic power level of the masking noise in the office area or any other area covered by the system, as measured at various specific frequencies within the audio-frequency band, is desirably controlled so that it substantially follows a prescribed curve. The shape of this curve represents an average of male and female speech or typical conversational speech effort with some modification at low frequencies in order to take into account air-conditioning and traffic noises.

Noise generators 50 and 52 produce random or white noise, which has the same power over the entire audio-frequency band. This type of noise thus has a power curve drastically different from the desired curve, particularly in that the high frequency components produce a sound that resembles the release of high pressure steam. Noise generators 50 and 52 can be any random noise generators and, for convenience and economy, preferably are simple white noise generators, such as the amplified thermal junction noise in a transistor. Noise generators 50 and 52 can include preamplifiers, if desired. Equalizer-amplifiers 54 and 56 are conventional amplifiers which have response over the audio-frequency range which is not linear, but has an output tailored partially toward the desired frequency band versus power curve.

The outputs of equalizer-amplifiers 54 and 56 are respectively the inputs of narrow band equalizers 58 and 60. Narrow band equalizers 58 and 60 are identical, and each has individually adjustable half-octave bands from 90 Hertz to 4 kiloHertz. The outputs of the equalizers 58 and 60 are the signal channels and go through ganged level controls 62 to power amplifiers 64 and 66. The power amplifiers deliver the amplified and equalized noise signals in first and second channels respectively to speaker sets A and B.

Narrow band equalizers 58 and 60 are expensive devices and are specialized devices which require individual setting; therefore, it is desirable to provide a system which does not require a complete separate channel with its own narrow band equalizer to power speaker set C. To accomplish a third channel of noise signal, the outputs of the narrow band equalizers 58 and 60 are summed in summer 68 with the summer output being a third signal channel which goes through the level control 62 to power amplifier 70 and thence to speaker set C. With such an arrangement, with the speaker array spaced on 10-foot centers, the sound level is uniform within 2 decibels in each of the half-octave bands. This prevents the listener in the room from hearing a particular tone or a particular speaker; thus, he is immersed in a sea of sound, rather than having the feeling of being positioned between speakers which are not producing compatible sound. Instead of the device 68 being a summer, it can just as well be a subtractor or another device which conveniently takes both signals and produces a third signal which has the same general equalized characteristics, but has different sound frequencies so that speakers of different sets do not beat against each other. It should be understood from the above description that equalization is defined as being the deliberate control of the power, as measured in different narrow frequency bands so that the frequency versus power spectrum curve is controlled. The individual narrow band control of the narrow band equalizers 58 and 60 is required to obtain satisfactory masking noise with this diversity system because of the varying frequency responses of speakers, speaker enclosures, ceiling tile materials, and the like, plus anomalies introduced within the space to be served by air-conditioning ducts in the plenum and various arrangements of furniture and dividers within the office space. Level control 62 is conveniently mounted for access in the office space, while the diversity system electronics system and power supply 72 can be conveniently mounted in an electronic cabinet 74 in an adjacent space.

As seen in FIG. 4, a modified arrangement can be employed wherein the first and second channel signals are combined after power amplification. The system of FIG. 4 is the same as that of FIG. 3 through the narrow band equalizers 58 and 60, the outputs of which are supplied respectively to power amplifiers 64 and 66 for signal channels A and B respectively, which supply their power-amplified signals to their respective speaker sets A and B, as before. In this arrangement, however, signal summation occurs after power amplification and is achieved via transformer 76, the primary winding 78 of which is connected between the outputs of power amplifiers 64 and 66. The power transformer's secondary 80 provides the derived channel signal C which is supplied to the speakers of set C. If the noise system is to be utilized with an alternative paging or monaural music mode, a small input transformer would be required.

Referring to FIG. 5, the above discussion with respect to FIG. 4 is equally applicable here, except that power transformer 76 has been replaced with two power transformers 82 and 84 so that their respective primary windings 86 and 88 are in phase reversal with respect to each other, with the secondary windings 90 and 92 in series-additive relationship. Insofar as the basic system is concerned, there is no particular difference between the arrangements of FIGS. 4 and 5; however, the system illustrated in FIG. 5 is compatible with a paging or monaural music mode of the operation of the speakers without modification of the summation arrangement.

This invention having been described in its preferred embodiment, it is clear that it is susceptible to numerous modifications and embodiments within the ability of those skilled in the art and without the exercise of the inventive faculty. Accordingly, the scope of this invention is defined by the scope of the following claims.

What is claimed is:

1. A system for noise-masking having a noise generation and masking system consisting of:

first and second noise generators for producing random noise;

first and second narrow band equalizers respectively connected to the outputs of said first and second noise generators for producing electronic signals equivalent to equalized audio-noise in first and second channels; and means connected to both said first and second channels for receiving and combining signals from said first and second channels to produce a third channel of electronic signal corresponding to equalized audio-noise, said electronic signals of said first, second and third channels being for controlling speakers for directing non-localizable masking noise into a work space.

2. The system of claim 1 including:

first, second and third power amplifiers respectively connected to said first, second and third channels.

3. The system of claim 2 including:

an array of speakers positioned to direct masking noise into work space, said first, second and third power amplifiers each being connected to selected ones of said speakers in said array.

4. The system of claim 3 wherein:

said array includes first, second and third sets of said speakers arranged in rows, one of said rows of speakers alternately containing speakers in said first set and said third set, and alternate ones of said rows containing speakers in said second set and said third set, with one of said lines alternately containing speakers in said second set and said third set so that, along any row and along any line, adjacent speakers belong to different sets.

5. The system of claim 1 wherein:

said means is a summer which adds the signals in said first and second channels.

6. The system of claim 1 wherein said means for receiving and combining signals comprises:

first and second power amplifiers respectively connected to said first and second channels; and transformer means connected between the outputs of said first and second power amplifiers for producing said third channel of electronic signal.

7. The system of claim 6 including:

an array of speakers positioned to direct masking noise into work space, the outputs of said first and second power amplifiers and said transformer each being connected to selected ones of said speakers in said array.

8. The system of claim 7 wherein:

said array includes first, second and third sets of said speakers arranged in rows, one of said rows of speakers alternately containing speakers in said first set and said third set, and alternate ones of said rows containing speakers in said second set and said third set, with one of said lines alternately containing speakers in said second set and said third set so that, along any row and along any line, adjacent speakers belong to different sets.

9. A noise-masking system comprising:

a loudspeaker array positioned to provide masking noise into a space, said loudspeaker array comprising first, second and third sets of speakers;

first and second noise generators, first and second equalizers respectively connected to said first and second equalizers respectively connected to said first and second noise generators, first and second channels connected to the outputs from said first and second equalizers so that said first and second channels carry independent electrical signals corresponding to equalized audio-frequency noise, said first and second channels being respectively connected to said first and second sets of speakers; and means connected to said first and second channels for combining the signals in said first and second channels for producing a third channel of different but related equalized audio-frequency signal, said third channel being connected to said third set of speakers.

10. The system of claim 9 wherein:

said sets of speakers are arranged in an array such that each speaker has only speakers of other sets adjacent thereto.

11. The system of claim 10 wherein:

said speaker array is arranged in rows, and one of said channels is connected to alternate speakers in one row and is connected to alternate speakers in the adjacent row.

* * * * *